United States Patent [19]

Lhymn et al.

[11] Patent Number: 5,034,283

[45] Date of Patent: Jul. 23, 1991

[54] ECONOMIC FABRICATION OF COMPOSITE ZINC ALLOYS

[75] Inventors: Chang Lhymn; Yoon O. Lhymn, both of Erie, Pa.

[73] Assignee: Summit Composites International, Erie, Pa.

[21] Appl. No.: 483,755

[22] Filed: Feb. 23, 1990

[51] Int. Cl.[5] ..... C22C 18/00; C22C 18/02; C22C 18/04

[52] U.S. Cl. ..... 428/614

[58] Field of Search ..... 428/614

[56] References Cited

PUBLICATIONS

Blain et al., "A Study of the Dry Abrasion of Zn–Al Matrix; Iron, Aluminum, $Al_2O_3$ Particles Composites", Processing of Ceramic and Metal Matrix Composites, Aug. 20–24, 1989, Chemical Abstract #112(12):103151k or Metals Abstract #90(3):62–204.

*Primary Examiner*—R. Dean
*Assistant Examiner*—David W. Schumaker
*Attorney, Agent, or Firm*—Ralph Hammar

[57] ABSTRACT

Chilled iron shots with the carbon content being about 3 weight % are mixed with zinc-based alloys containing copper at a temperature between the liquidus and solidus of the matrix phase alloy such that the matrix alloy becomes a mixture of liquid and solid phase particles. Such slurry state mixture is agitated to form a vortex and the iron shots are injected to the vortex zone. The composite zinc alloy fabricated by the preceding slurry vortex method is very economical without degrading the physical/mechanical behavior compared to conventional zinc alloys. The copper or zinc coating on iron shots tends to improve the wetting adhesion between shots and matrix alloy, thus eliminating defects at the interphase between shots and matrix phase.

10 Claims, No Drawings

ECONOMIC FABRICATION OF COMPOSITE ZINC ALLOYS

This application is an improvement on: Serial No. 07/314,950 filed Feb. 23, 1989, utilized the concept of Serial No. 07/187,734, filed 04/29/88, (Patent 4,962,003); Serial No. 07/197,170, filed 05/23/88, (Patent 4,927,712); Serial No. 07/290,743, filed 12/27/88, (Continuation Serial No. 07/593,307, filed 10/02/90); Serial No. 07/314,950, filed 02/23/89; Serial No. 07/385,379, filed 07/27/89.

BACKGROUND OF THE INVENTION

Prior art on zinc alloys as described in Ser. No. 07/314,950 filed Feb. 23, 1989 utilized the concept of fluxing to induce intermetallic bonding between reinforcing shots and zinc alloy matrix. The elimination of flux will reduce the fabrication cost of zinc alloys when the reinforcing shots are cheap and readily available like chilled iron shots. The goal of the present invention is to develop such economic method of manufacturing zinc-based alloys while maintaining comparable mechanical/physicochemical properties of conventional zinc alloys such as ZAMAK 3, ZAMAK 5, ZA 8, or ZA 12. These alloys have been used in zinc die casting industry to manufacture decorative, functional, and structural parts. The primary aim of the present invention is to replace part of zinc element used in producing such parts with cheap iron shots such that the cost of final parts can be reduced without any serious adverse effect on manufacturing and performance behavior.

SUMMARY

Zinc-based zinc-aluminum alloys containing copper greater than about 0.4 weight % are mixed with reinforcing cast iron shots with the carbon centent of about. 2 weight % or higher under agitation in the slurry state. The slurry state is a mixture of liquid and solid phase, the ratio of their relative amount being dependent on the working temperature. Iron shots often have a bondable metallic coating such as copper, zinc, or nickel to improve the wetting adhesion between shots and matrix alloy. The zinc alloy matrix/ shots composite alloy is die cast using the hot-chamber or cold-chamber process or simplt gravity cast. The new zinc alloy is less expensive to manufacture than conventional zinc alloy while maintaining comparable physical/mechanical properties.

DETAILED DESCRIPTION OF THE PREFERRED INVENTION

Cast iron shots with the carbon content being greater than about 2 weight % are mixed with zinc-based alloys which are agitated vigorously to form a vortex in the slurry state. The slurry state is formed at a temperature between the liquidus and solidus of the matrix alloy such that part of the matrix phase is in the solid phase fine particle and the rest of the matrix is in the liquid state. The bonding of iron shots to the zinc alloy is achieved by injecting shots to the vortex formed by agitating the molten alloy in the slurry state. The slurry [illegible] formation is critical in mixing since the primary alpha phase solid particles in the liquid phase alloy break up the clustering of shots. In the die-casting or gravity casting process, the pot holding the molten composite alloy is continuously stirred to maintain the homogenuous distribution of shots. The preceding description of fabrication steps reveals the following key aspects.

(1) Iron shots of high carbon content
(2) Copper ingredient in the zinc-based alloy matrix
(3) Agitation in the slurry state The critical element in iron shots is the carbon content as it controls the reaction rate between zinc and iron. Low-carbon steel shots react with zinc quite rapidly even though the melt temperature is lower than about 830 degree F., above which the reaction rate appears to be rapid regardless of the carbon content. Chilled iron shots containing about 2 to 5 weight % carbon as well as silicon, molyndenum, sulfur, phosphorus, manganese, and other impurities are far less reactive with zinc than steel shots at a temperature lower than about 830 degree F. The matrix alloys are comprised of a major element of zinc and a minor element consisting of aluminum, copper, magnesium, and a trace amount of impurities such as tin, lead, cadmium, and iron. Any zinc alloys whose liquidus temperature is lower than about 830 degree F. can be mixed with iron shots when shots are bondable. Since the liquidus temperature of ZA 27 alloy is higher than 830 degree F., it is not recommended to produce ZA 27/iron shots composite. The cost of reinforcing agents must be cheaper than zinc alloy matrix to be economically feasible and thus, when iron shots contain expensive elements such as molybdenum, niobium, tantalum, and the like, the final cost of producing such specialty iron shots must be less than zinc alloy cost, although such specialty shots may prevent reaction between zinc and iron. Also the addition of such special elements to iron shot must not degrade the physicochemical properties of composite zinc alloys as a whole. For example, the addition of aluminum element to iron shot may induce brittleness although the aluminum metal may be cost-effective like carbon. The spherical shot geometry is the most logical shape in terms of melt-flow behavior,i.e., die castability. Even in gravity casting, the flowability is essential to produce defects-free and smooth surface part. With the increase of carbon content in iron the density decreses but the amount of iron carbide phase increases and therefore the carbon content in iron shot is limited up to about 10 to 20 weight %. The size of shot must be small enough not to block the gate and to meet the geometrical shape details. The content of shot must be lower than about 30 to 40 weight % not to degrade the flow behavior but greater than about 5 to 10 weight % to have a cost-saving effect as well as strength enhancement.

Commercially available iron shots are mixable with conventional zinc-based zinc-aluminum alloys such as ZAMAK 3, ZAMAK 5, ZAMAK 7, ZA 8, or ZA 12 alloys when they contain copper element greater than about 0.4 weight % but not mixable when the copper content is about 0.25 weight % as in ZAMAK 3. Therefore it is required that the copper content in zinc-aluminum alloys must be greater than about 0.4 weight % for iron shots to be mixed and to be flowable in such alloys. As the copper content increases the flowability deteriorates and the alloy cost rises. Also the melting point increases with the increase of copper amount and thus the copper content is limited to be less than about 4 to 6 weight %.

In the afore-mentioned prior art, the process was done in air using a flux. The fluxing technique for zinc-aluminum alloys is not effective in terms of cost and physicochemical behavior, especially producing excessive surface residues. The presence of aluminum in the amount greater than about 3 weight % in zinc alloys reduces the harmful zinc-iron reaction rate and hence it is ideal to mix iron shots directly with the zinc-aluminum alloy rather than molten zinc plus steel shot reaction followed by aluminum addition. The problem of fluxing technique in zinc-aluminum alloys lies in the presence of tenacious surface oxide film on molten alloys. This barrier is overcome by utilizing the slurry state molten alloy and by forming a vortex via agitation. Iron shots are then injected to the slurry-vortex zone under a continuous stirring motion to enhance the mobility of shots and melt. The slurry state is achieved by selecting the range of temperature in which both solid liquid phases coexist and the relative ratio of solid to liquid phase amount depends on the operating temperature.

In order to improve the wetting behavior, copper or zinc coating on iron shots is tried and mixed with zinc-based alloys in the state of slurry agitation. The presence of copper or zinc as a coupling agent enhances the bonding between shots and zinc alloy matrix phase, thus eliminating defects such as microvoids or cracks. Nickel coating can be another alternative technique but the cost of nickel coating prohibits its commercializability.

In the hot chamber die-casting process using the immersed gooseneck, the vertical plunger follows the following sequential motion for one shot injection cycle. The plunger remains in "down" position for most of one casting cycle. During the period of shot injection the plunger moves upward to fill the goose-neck chamber with the molten alloy and then quickly moves downward to inject the shot to the mold. The whole duration of this upward-downward movement of plunger is about 2 to 3 seconds. The plunger stays in the "down" position for the next 20 to 30 seconds until the next shot is to be performed. This kind of operating mode eliminates the possibility of settling-down of iron shots inside the goose-neck chamber which is isolated from the agitation effect in the holding furnace. However before the die opens, the plunger moves upward slightly to relieve the back-pressure in the gooseneck runner channel.

In the cold chamber process, the simple ladling action transports the alloy to the mold via horizontal piston ram movement.

As an economical reinforcement, any iron-based shots can be used when they are bondable and nonreactive with zinc-based matrix alloys.

EXAMPLE 1

As received chilled iron shots with 2.8 to 3.2 weight % carbon were cleaned in sodium hydroxide solution, rinsed, dipped in dilute hydrochloric acid, rinsed, and then tumble dried prior to mixing with the zinc-based alloys. The iron shots were then injected to the vortex of the agitated slurry of molten zinc alloy bath. The content of iron shots is about 20 to 25 weight % of the composite alloy and the size of shots is less than about 0.028 inch in diameter. The composite alloy is then die-cast by the hot chamber process in which the gate thickness of the mold must be large enough to allow the flow of shots. The kinds of zinc alloys as a matrix are ZAMAK 5, ZA-8, ZA-12. and modified ZAMAK 3 as follows.

| | | |
|---|---|---|
| (1) ZAMAK 5: | copper | 0.75–1.25 wt. % |
| | aluminum | 3.5–4.3 |
| | magnesium | 0.03–0.08 |
| | lead | 0.005 |
| | cadmium | 0.004 |
| | tin | 0.003 |
| | iron | 0.1 |
| | zinc | remainder |
| (2) ZA-8: | copper | 0.8–1.3 wt. % |
| | aluminum | 8.0–8.8 |
| | magnesium | 0.015–0.03 |
| | iron | 0.1 |
| | lead | 0.004 |
| | cadmium | 0.003 wt. % |
| | tin | 0.002 |
| | zinc | remainder |
| (3) ZA-12: | aluminum | 10.5–11.5 wt. % |
| | copper | 0.5–1.25 |
| | magnesium | 0.015–0.03 |
| | iron | 0.075 |
| | lead | 0.004 |
| | cadmium | 0.003 wt. % |
| | tin | 0.002 |
| | zinc | remainder |
| (4) Modified ZAMAK 3: | aluminum | 3.5–4.3 wt. % |
| | magnesium | 0.02–0.05 |
| | iron | 0.1 |
| | lead | 0.005 |
| | cadmium | 0.004 |
| | tin | 0.003 |
| | copper | 0.4–0.7 |
| | zinc | remainder |

EXAMPLE 2

Chilled iron shots were precleaned and then copper coated by chemical or mechanical means. They were then mixed with zinc-based alloys in the agitated slurry state The content of iron shots is about 20 to 30 weight % of the composite alloy and the shot size is less than about 0.028 inch in diameter. The matrix alloys as described in example 1 were used.

While the invention has been described with reference to certain preferred embodiments thereof, those skilled in the art will appreciate that various modifications, changes, omissions, and substitutions may be made without departing from the spirit of the invention. It is intended, therefore, that the invention be limited only by the scope of the following:

I claim:

1. A zinc-based composite alloy, comprising: a matrix consisting of zinc-based alloy having a melting point of 830° or less; and spherical reinforcing case iron shots dispersed in and bonded to said matrix, said iron shots being nonreactive with said zinc alloy matrix at an elevated temperature at which said shots are composited with said matrix.

2. The composite alloy according to claim 1, wherein said shots for said matrix is provided in solid spheres.

3. The composite alloy according to claim 1, wherein said matrix alloy is comprised of a major element of zinc and minor elements of aluminum, copper, magnesium, and other impurities of lead, cadmium, tin, and iron with the copper content being greater than about 0.4 weight % and the aluminum content being greater than about 3 weight %.

4. The composite alloy of claim 1, wherein said cast iron shots contain carbon element greater than about 2 weight %.

5. The composite alloy according to claim 1, wherein said shots are any case iron alloy bondable to and nonreactive with said zinc-based matrix alloys.

6. The composite alloy of claim 1, wherein said iron shots have a diameter less than about 1 mm.

7. The composite alloy of claim 1, wherein said iron shots are present in the amount of less than about 40 weight % of said composite alloy.

8. The composite alloy of claim 1, wherein said shots are coated with a bondable metal of copper, nickel, or zinc, or other bondable metals.

9. The zinc-based alloy matrix of claim 1 in which said iron shots are mixed with zinc-based alloy at elevated temperatures at which said zinc-based alloy is in the liquid state and said shots are in the solid state.

10. The composite alloy of claim 1, wherein said iron shots are present in the amount greater than about 5 weight % of said composite alloy.

* * * * *